US005143163A

United States Patent [19]

Stiffler et al.

[11] Patent Number: 5,143,163

[45] Date of Patent: Sep. 1, 1992

[54] DIGGING TOOTH

[75] Inventors: Stephen P. Stiffler, New Enterprise; David J. Waite, Bedford, both of Pa.; Robert L. Frost, Sherman, Tex.; Wayne H. Beach, Roaring Spring, Pa.

[73] Assignees: Kennametal Inc., Latrobe, Pa.; Reedrill Inc., Sherman, Tex.

[21] Appl. No.: 751,914

[22] Filed: Aug. 29, 1991

[51] Int. Cl.[5] ..... E21B 10/44; E21B 10/56; E21B 10/62

[52] U.S. Cl. ..... 175/385; 175/394; 175/431; 175/432; 299/87; 299/90; 299/91

[58] Field of Search ..... 175/385, 394, 431, 432, 175/428, 413, 412; 299/88-93; 37/142 R; 172/123

[56] References Cited

U.S. PATENT DOCUMENTS

| | | | |
|---|---|---|---|
| 2,780,439 | 9/1954 | Kandle | 175/391 |
| 2,817,497 | 12/1957 | Lines | 175/391 |
| 2,968,880 | 2/1959 | Petersen | 37/142 |
| 3,136,077 | 6/1962 | Troeppl | 37/142 |
| 3,235,018 | 2/1966 | Troeppl | 175/391 |
| 3,300,883 | 10/1963 | Troeppl et al. | 37/142 |
| 3,426,860 | 2/1969 | Petersen | 175/392 |
| 3,693,736 | 9/1972 | Gardner | 175/410 |
| 3,704,753 | 12/1972 | Hasforth et al. | 172/700 |
| 3,720,273 | 3/1973 | McKenry et al. | 175/335 |
| 3,736,676 | 6/1973 | Sturgeon | 37/142 R |
| 3,737,199 | 6/1973 | Stephenson | 299/89 |
| 3,763,942 | 10/1973 | Levitt | 175/394 X |
| 3,773,122 | 11/1973 | Chromy | 175/385 |
| 3,794,129 | 2/1974 | Taylor | 175/391 |
| 3,821,993 | 7/1974 | Kniff et al. | 175/292 |
| 3,830,321 | 8/1974 | McKenry et al. | 175/332 |
| 3,841,709 | 10/1974 | Kniff | 299/88 |
| 3,924,697 | 12/1975 | College | 175/382 |
| 4,046,207 | 9/1977 | Taylor | 175/391 |
| 4,214,617 | 7/1980 | McKenry | 144/2 N |
| 4,316,636 | 2/1982 | Taylor et al. | 299/92 |
| 4,326,592 | 4/1982 | Stephenson | 172/123 |
| 4,380,271 | 4/1983 | Baker et al. | 175/391 |
| 4,415,208 | 11/1983 | Goyarts | 299/91 |
| 4,499,958 | 2/1985 | Radtke et al. | 175/329 |
| 4,660,660 | 4/1987 | Yuh | 175/410 |
| 4,666,214 | 5/1987 | Beach | 299/92 |
| 4,674,802 | 6/1987 | McKenna et al. | 299/79 |
| 4,702,525 | 10/1987 | Sollami et al. | 299/79 |
| 4,725,098 | 2/1988 | Beach | 299/79 |
| 4,830,123 | 5/1989 | Daly et al. | 175/329 |
| 4,865,392 | 9/1989 | Penkunas et al. | 299/86 |
| 4,917,196 | 4/1990 | Stiffler et al. | 175/385 |
| 4,932,723 | 6/1990 | Mills | 299/86 |

OTHER PUBLICATIONS

"Texoma Auger Tooling Products" brochure, Reedrill Inc., Sherman, Texas.

*Primary Examiner*—Stephen J. Novosad
*Attorney, Agent, or Firm*—John J. Prizzi; Larry R. Meenan

[57] ABSTRACT

A replaceable digging tooth for an earth auger including a generally oblong body member and a shank depending from the body member and receivable in a support block of the earth auger. The body member includes an elongated leading surface, an elongated trailing surface and first and second side surfaces. The leading surface, trailing surface and first and second side surfaces terminate in a forward working face having a plurality of inserts. Each insert has a generally cylindrical portion integral a top portion which tapers to a point to form a conical tip. The tips of the inserts are aligned to define a linear cutting line which is inclined with respect to a reference plane perpendicular to the axis of the shank and the axes of the inserts are aligned parallel to form a cutting plane which is inclined with respect to the reference plane.

26 Claims, 5 Drawing Sheets

DIGGING TOOTH

FIELD OF THE INVENTION

The present invention relates to a replaceable digging tooth for an earth auger. More particularly, the present invention relates to a new and improved replaceable digging tooth for an earth auger adapted for boring holes in rock formations.

BACKGROUND OF THE INVENTION

Earth augers for boring holes in the earth are well known in the art and exemplified by U.S. Pat. No. 4,380,271. This patent describes an auger including a dual flight. Each flight has a leading edge which commences adjacent a pilot bit and a trailing edge which terminates adjacent a chuck. The flights concurrently spiral about a central shaft. A plurality of excavating teeth are arranged in step, radial fashion along the leading edges of the auger flights. During the drilling operations, the cutting teeth cut annular zones of increasing diameter as the auger progresses into the earth.

Various types of teeth useful in earth augers are well known. One type of tooth useful in an earth auger which may be used for rock cutting and drilling is described in U.S. Pat. Nos. 3,924,697 and 3,821,993.

The cutting tooth used in connection with an earth auger typically includes a main body portion terminating in a working end and a shank extending therefrom for insertion into a socket of a holder on the leading edge of the auger. One or more flat style inserts are disposed in the recess and are shaped to form a point.

Another style of digging tooth includes a conical style insert made of a hard wear resistant material mounted within a tooth body secured to auger plates or weld on tooth holders. The cutting teeth are inclined about the body of the auger in the direction of rotation of the auger. As the cutting teeth cut into a work surface, the cutting teeth rotate within the respective block mounts to maintain the sharpness of the cutting tooth insert. It will be appreciated that the conical cutting tooth insert is typically a wear resistant cemented carbide insert having a conical shape. The conical insert utilized on this type of tool is commonly between 0.3 and 0.75 inches in diameter to provide sufficient strength and allow for adequate surface contact with the work surface.

It will also be appreciated that due to the size of the individual cutting teeth and block assemblies, the number of cutting teeth that may be secured to the auger is limited by the size of the cutting tooth and cutting block assemblies mounted on the auger and the distance between the various cutting teeth positioned about the body of the auger. To provide increased cutting tooth action, the tendency in the industry has been to increase the diameter of the conical style insert and decrease the number of cutting teeth mounted about the auger. Although increasing the cutting tooth size and decreasing the number of cutting teeth mounted about the auger has increased the cutting action, it has also decreased the cutting efficiency of the auger. More particularly, as the cutting teeth are brought into contact with a work surface, large areas of the work surface between the cutting teeth are not affected and thus not cut away. The nonremoval of portions of the work surface, such as a rock surface, is known as coring. Coring is recognized as causing excessive wear of the body of the rock auger tooth as well as impeding the penetration of the auger.

Yet another style of rock auger tooth is disclosed in U.S. Pat. Nos. 3,426,860; 3,300,883; 3,136,077 and 2,968,880. The teeth disclosed in U.S. Pat. Nos. 3,426,860; 3,300,883; 3,136,077 and 2,968,880 generally include a tapered distal portion which performs the digging function and a bifurcated proximal portion composed of two prongs separated from each other by a rectangular slot which extends forwardly from the proximal end of the teeth. Each tooth may include a straight transverse cutting edge or a plurality of chisel style carbide inserts having a straight transverse cutting edge. When engaged in a hard work surface such as rock, the transverse chisel style cutting edge has a tendency to grind and pulverize the surface to be cut and resist penetration into the work surface.

Moreover, as disclosed in U.S. Pat. No. 3,426,860, the body of the tooth is formed of a relatively soft material in relation to the hard inserts such that the body of the tooth wears and recedes whereas the hard inserts do not wear rapidly thus shortening the useful life of the tooth body. This problem is exacerbated by the minimal gage between the tip of the chisel style carbide insert and the tooth body such that during cutting of the work surface the tooth body is exposed to the abrasive pulverized cut work surface.

To alleviate the aforementioned problems, such as preventing excessive wear of the body of the tooth and providing a more efficient cutting tooth, we have invented a replaceable digging tooth for an earth auger having a plurality of cutting inserts of a specific shape which possesses sufficient gage clearance to prevent excessive wear of the tooth body and provides superior cutting action.

Accordingly, it is an aspect of the present invention to provide a replaceable digging tooth for an earth auger having a plurality of conical cutting inserts. The replaceable digging teeth in accordance with the present invention may utilize existing known means for holding the digging teeth to existing earth augers for improved economy.

Another aspect of the present invention is to provide a replaceable digging tooth for an earth auger having a plurality of conical cutting inserts which provide maximum rock cutting action by increased cutting pressure.

It is a further aspect of the present invention to provide a replaceable digging tooth for an earth auger having a plurality of conical cutting inserts which provide increased gage distance between the tip of each insert and the tooth body for improved cutting penetration, longer tooth body life and less cutting resistance.

Yet another aspect of the present invention is to provide a replaceable digging tooth for an earth auger having a plurality of conical cutting inserts brazed into individual insert receiving holes to allow for proper gage distance.

Another aspect of the present invention is to provide a digging tooth for an earth auger that has improved penetration in hard rock and improved life and wear properties.

Another aspect of the present invention to provide a replaceable digging tooth for an earth auger having a plurality of conical cutting inserts that is simple and economical to manufacture.

SUMMARY OF THE INVENTION

The present invention relates to an earth auger for boring holes in rock formations. The auger includes a dual flight. Each flight has a leading edge and spirals about the central shaft. A plurality of support blocks are fixed to the leading edge of each flight for receiving and holding replaceable digging teeth. Preferably, the replaceable digging teeth are arranged to cut within the distinct annular zones of increasing diameter from the innermost digging tooth to the outermost digging tooth.

The replaceable digging tooth for an earth auger includes a generally oblong body member and a shank depending from the body member and receivable in the support block of the earth auger. The body member includes an elongated leading surface, an elongated trailing surface and first and second side surfaces. The leading surface, trailing surface and first and second side surfaces terminate in a forward working face having a plurality of inserts. Each insert has a generally cylindrical portion integral a top portion which tapers to a point to form a conical tip. The tips of the inserts are aligned to define a linear cutting line which is inclined with respect to a reference plane perpendicular to the axis of the shank and the axes of the inserts are aligned parallel to form a cutting plane which is inclined with respect to the reference plane.

BRIEF DESCRIPTION OF THE DRAWINGS

Further features and other aspects of this invention will become clear from the following detailed description made with reference to the drawings in which.

DESCRIPTION OF THE PREFERRED EMBODIMENTS

Figure 1:
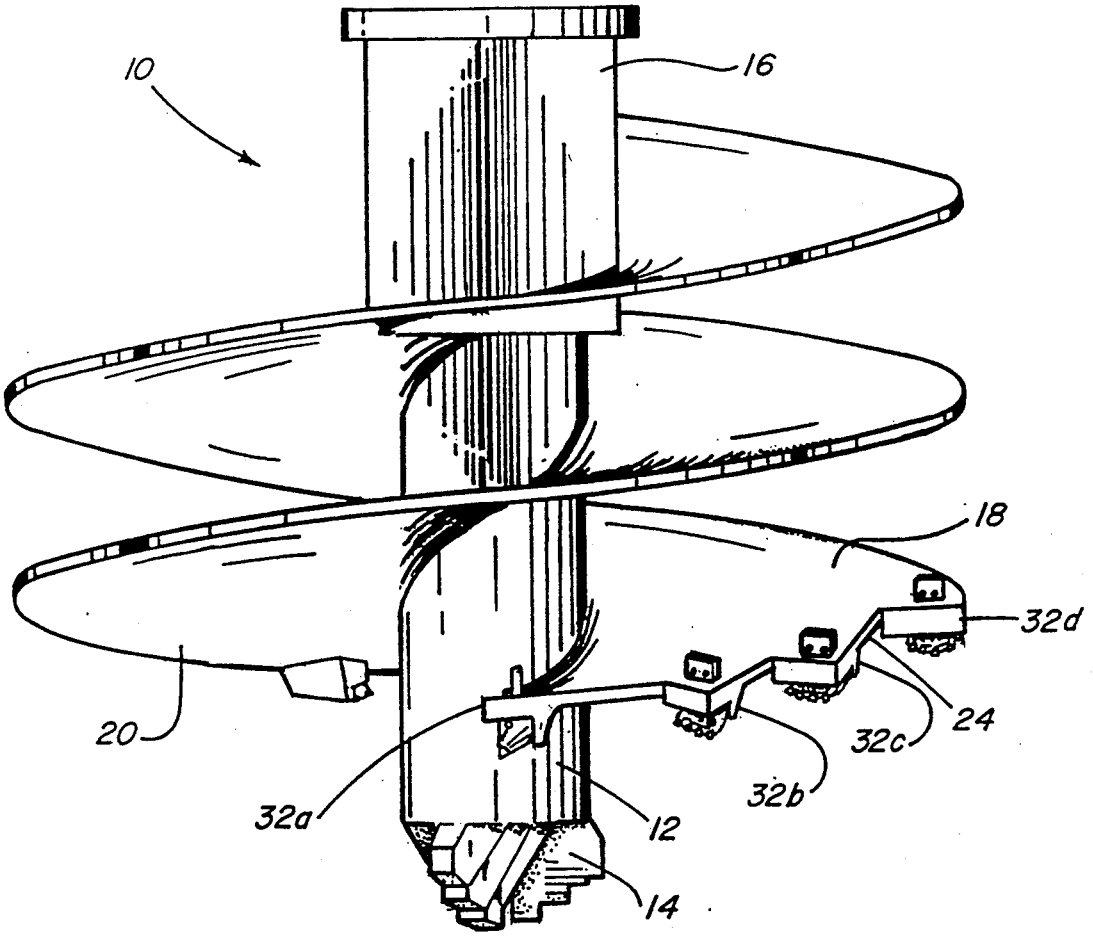
FIG. 1 is an elevational view of an earth drilling auger.

Referring to the drawings, wherein like reference characters represent like elements, FIG. 1 generally illustrates an auger 10 for boring holes in the earth. The auger 10 has a central shaft 12. A pilot bit 14 is affixed to the lower end of the shaft 12. The upper end of the shaft 12 terminates in a chuck 16 for connecting the auger 10 to a drive shaft (not shown).

The auger 10 further includes a pair of flight structures 18 and 20 in the form of spiraling webs. The flight structures 18 and 20 are rigidly fixed to the central shaft 12 and extend radially therefrom. Each of the flight structures 18 and 20 includes a leading edge 24 which terminates adjacent to the pilot bit 14.

The leading edge 24 of the flight structure includes a plurality of support blocks 32 of conventional design. Each block 32 is formed with a tooth receiving pocket 34 extending through the block 32 for receiving the shank portions of the digging teeth 40. The innermost support block **32*a* is disposed along the innermost edge of the flight structures adjacent to the pilot bit 14 and provides means for mounting the innermost digging tooth. Support block 32*d* is located adjacent the outer rim of the flight structure while one or more intermediate support blocks 32*b* and 32*c* are disposed between the innermost and outermost support blocks. Digging teeth 40 are received in the pockets of each of the support blocks 32 and are interchangeable between all of the tooth receiving pockets 34**.

Figure 2:
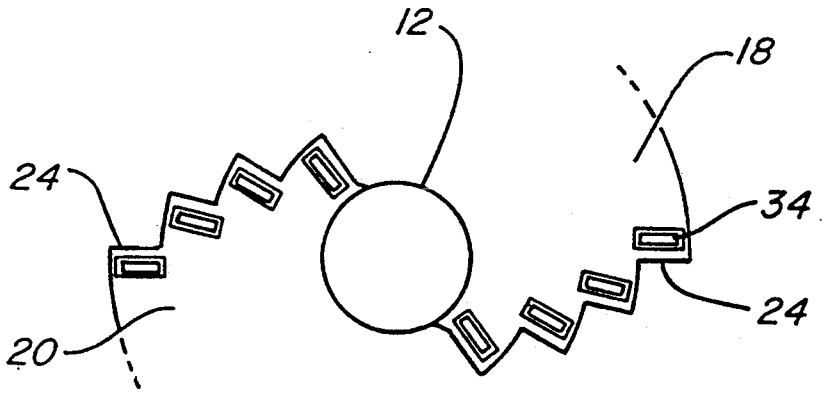
FIG. 2 is a partial plan view of the auger illustrating the leading edge of the flight structures.

As shown best in FIG. 2, the tooth holding blocks 32 are spaced along the leading edge 24 of each flight structure 18 and 20 in step radial fashion. Each of the digging teeth 40 lie in a different radial plane with respect to the axial centerline of the shaft 12. Further, each of the digging teeth 40 are radially spaced with respect to the centerline of the shaft 12 so that upon rotation of the auger 10, the digging teeth 40 cut a series of concentric holes of increasing diameter.

Referring now to FIGS. 3–10, the details of a replaceable digging tooth 40 for an earth auger 10 are shown. The replaceable digging tooth 40 includes a generally oblong body member 42, and a shank 44 depending from the body member for insertion into a tooth receiving pocket 34 of a support block 32. The axis 46 of the body member 42 and the axis 48 of the shank 44 are nonaligned. The axis 46 of the body member 42 and the axis 48 of the shank 44 form an angle $\theta$ which may vary from more than about 90 degrees to about 180 degrees. In one embodiment of the present invention, the angle $\theta$ formed between the axis 46 of the body member 42 and the axis 48 of the shank 44 is approximately 140 degrees, FIG. 5; and in yet another embodiment of the present invention the angle $\theta$ formed between the axis 46 of the body member 42 and the axis 48 of the shank 44 is approximately 175 degrees, FIG. 9.

The shank 44 of the digging tooth 40 is preferably of a nonsymmetrical shape, such as a rectangular shape, such that when placed in a support block 32 of an earth auger 10 having a pocket 34 of similar size and shape, the tooth will not rotate in the block. The shank 44 may be secured within the block 32 by any known means such as described in U.S. Pat. No. 4,917,196, assigned to Kennametal Inc.

Figure 11:
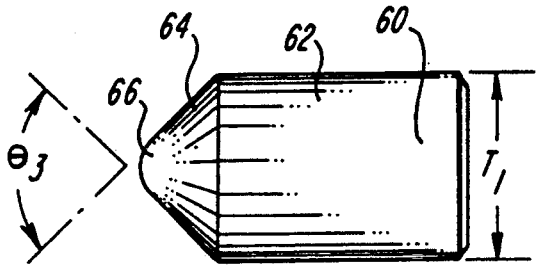
FIG. 11 is a side view of an insert for use in the digging tooth for an earth auger in accordance with the present invention.

The body member 42 of the digging tooth 40 includes an elongated leading surface 50, an elongated trailing surface 52, and first and second side surfaces 54 and 56. Depending upon the angle of inclination formed by the axis 46 of the body member 42 and the axis 48 of the shank 44, the side surfaces 54 and 56 may be of substantially the same thickness as the shank 44, FIG. 9, or the side surfaces may be of a thickness larger than the shank, FIG. 5, to provide additional structural support to the digging tooth 40. The leading surface 50, trailing surface 52 and first and second side surfaces 54 and 56 converge to form a forward working face 58 having a plurality of inserts 60 made of a hard wear resistant material such as cemented tungsten carbide. The inserts 60, as shown in FIG. 11, have a generally cylindrical portion 62 and a top portion 64 which tapers to a point to form a conical tip 66. The cylindrical portion 62 of the insert 60 is secured within an appropriately matching cavity 68 within the working face 58 of the tooth 60.

Figure 4:
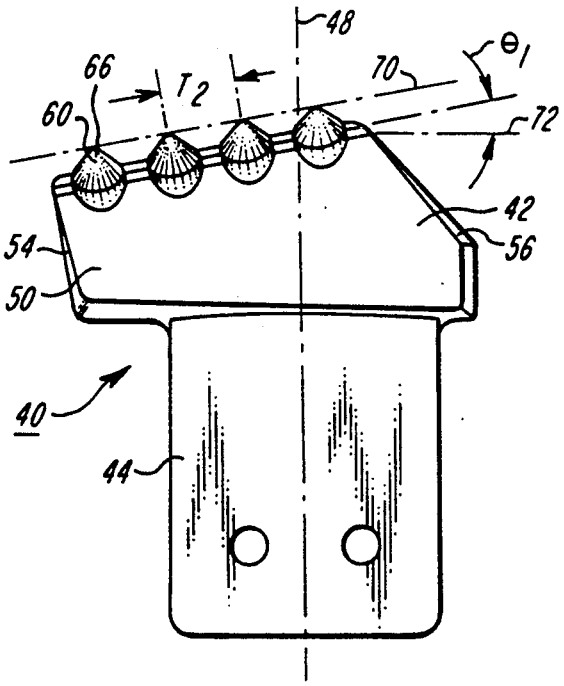
FIG. 4 is a front view of the digging tooth of FIG. 3.
Figure 5:
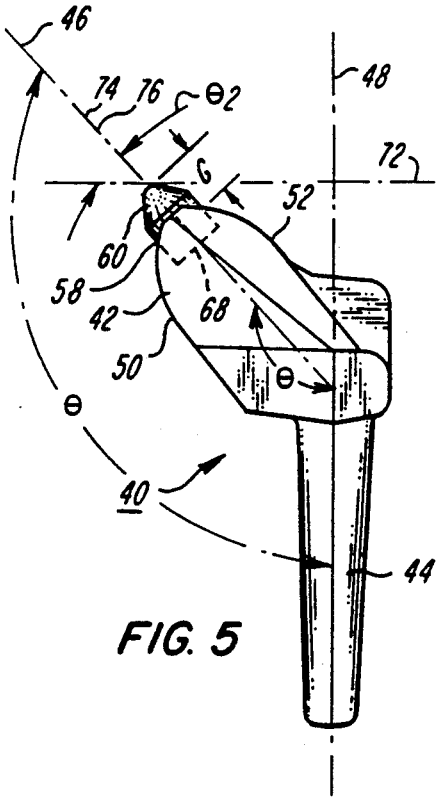
FIG. 5 is a side view of the digging tooth of FIG. 3.
Figure 6:
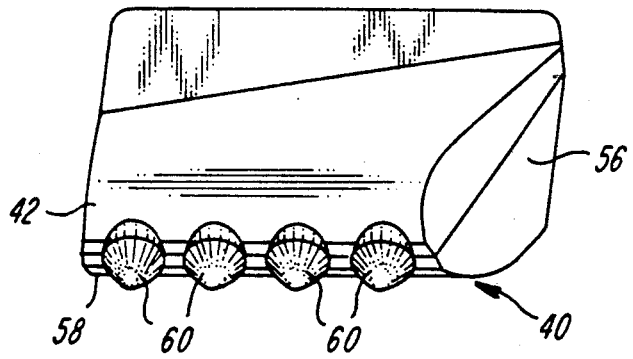
FIG. 6 is a top view of the digging tooth FIG. 3; of FIG. 3.
Figure 8:
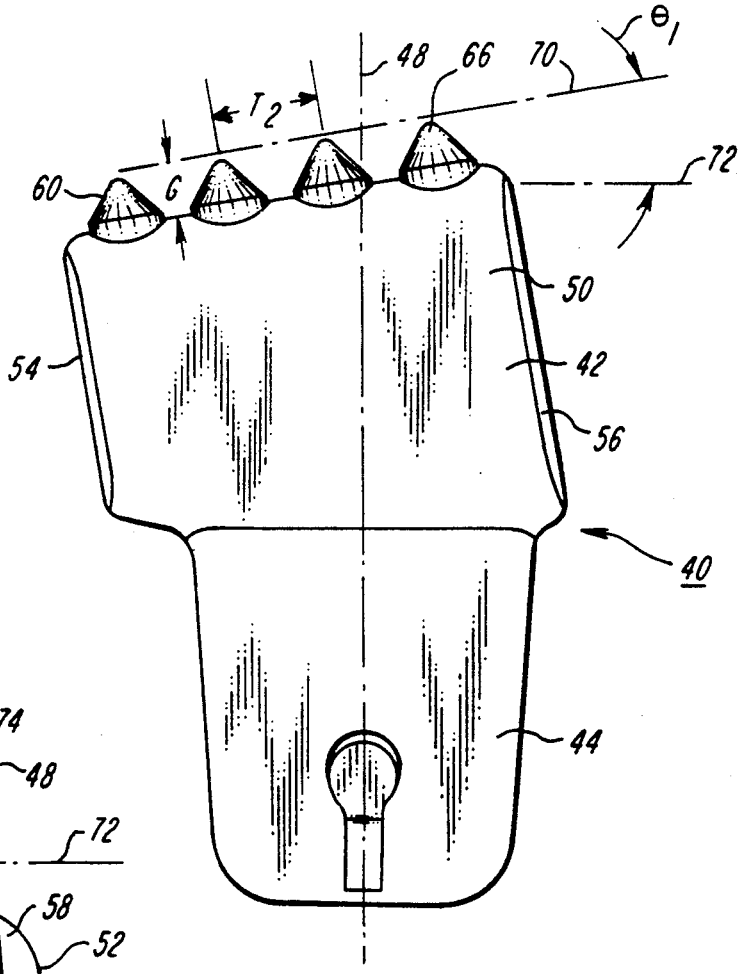
FIG. 8 is a front view of the digging tooth of FIG. 7.
Figure 9:
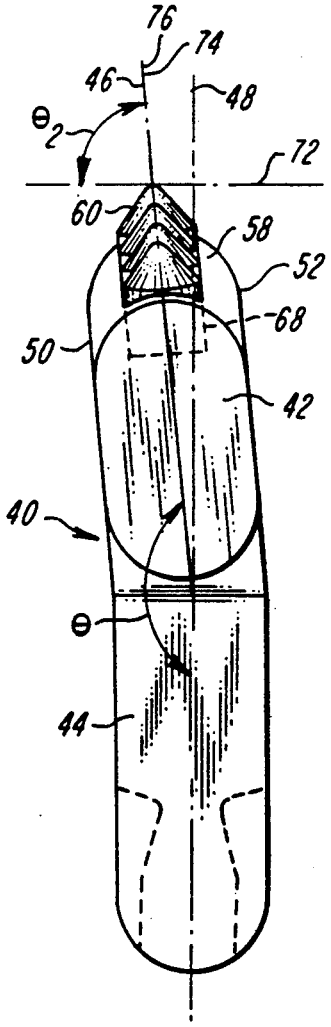
FIG. 9 is a side view of the digging tooth of FIG. 7.
Figure 10:
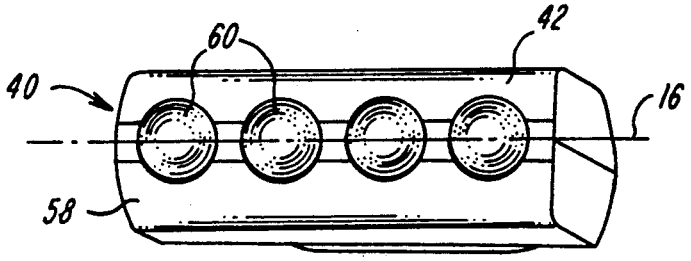
FIG. 10 is a top view of the digging tooth of FIG. 7.

As shown in FIGS. 4 and 8, the conical tips 66 of each insert 60 are linearly aligned to define a cutting line 70 inclined with respect to a reference plane 72 perpendicular to the axis 48 of the shank 44. As shown in FIGS. 4 and 8, the angle of inclination $\theta_1$ of the cutting line 70 with respect to the reference plane 72, is an acute angle of inclination, and preferably, of approximately 10 degrees. Similarly, the axes 74 of the inserts 60, which may be coincident with the axis 46 of the body member 42, are aligned parallel to form a cutting plane 76 which is inclined with respect to the reference plane 72. As shown in FIGS. 5 and 9, the angle of inclination $\theta_2$ of the cutting plane 76 with respect to the reference plane 72, is also an acute angle of inclination, and may vary from approximately 5 to 50 degrees.

Figure 3:
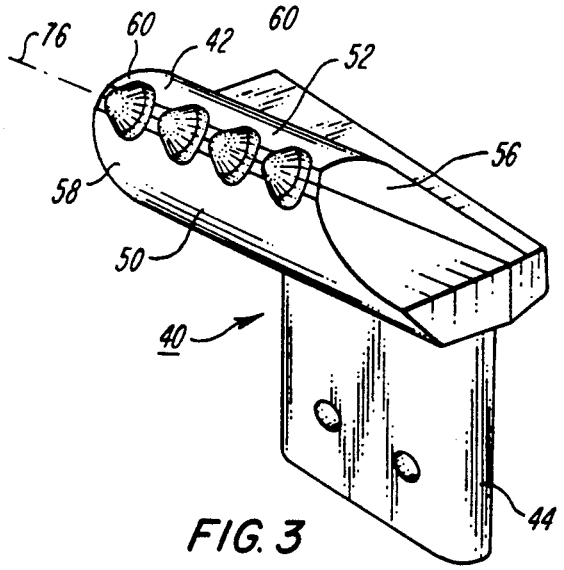
FIG. 3 is a perspective view of a digging tooth for an earth auger in accordance with the present invention.
Figure 7:
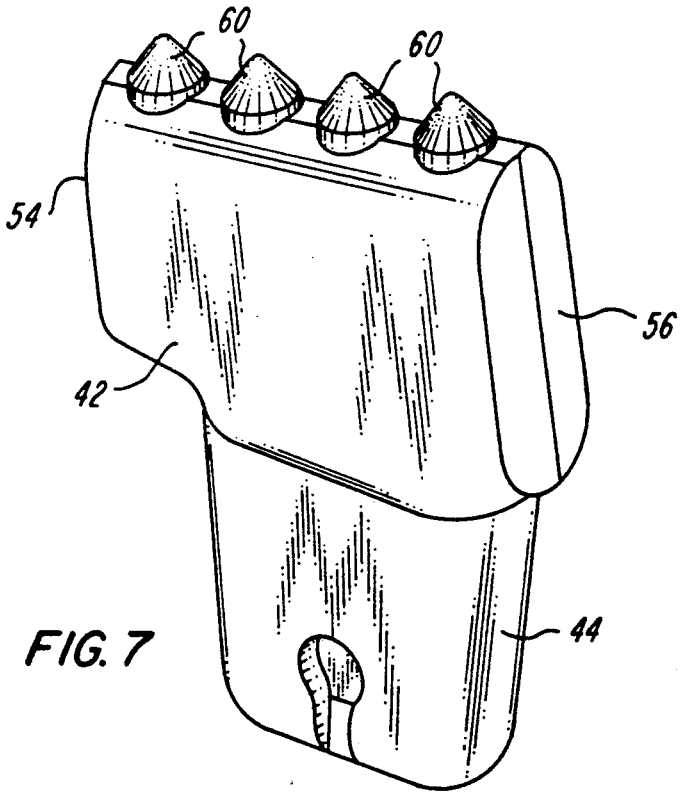
FIG. 7 is a perspective view of another digging tooth for an earth auger in accordance with the present invention.

The conical style inserts 60 employed in the tooth bodies of the present invention provide appreciably less insert surface area in contact with a work surface than a chisel style insert or a flat style insert and thereby provide an increased cutting force per unit area of work surface based upon equal load applied by the digging tooth 40. As shown in FIGS. 3 and 7, there are four cemented tungsten carbide inserts 60 secured to the forward working face 58 of the tooth 40 to provide a point contact cutting attack for more efficient cutting action and penetration.

In accordance with the present invention, applicants have found that for maximum cutting efficiency and to protect the body member of the digging tooth 40, the ratio of the diameter of the cylindrical body portion 62 of an insert $T_1$ to the spacing distance between the centers of the conical tips of the inserts $T_2$ must be between 0.45 and 0.80, and preferably, between 0.50 and 0.80. If $T_2$ is less than 0.50, then excessive material wear of the body member 42 of the digging tooth 40 will result because of coring. If $T_2$ is greater than 0.80, the inserts 60 are positioned too close together, resulting in a weakening of the strength of the body member 42 of the digging tooth 40. Also, if the inserts 60 are positioned too close, penetration of the digging tooth 40 and material flow during cutting action is restricted, resulting in inferior cutting penetration.

In a most preferred embodiment of the present invention, the ratio between the diameter of the cylindrical portion 62 of an insert $T_1$ and the spacing distance between the centers of the conical tips 64 of the inserts $T_2$ is 0.72.

In accordance with the present invention, applicants have also found that the tip angle $\theta_3$, formed by the tapered conical tip 64 of the insert 60, may vary from between 60 degrees and 90 degrees. To provide the most effective cutting action, the tip angle $\theta_3$ is preferably approximately 75 degrees. The inserts 60 are typically brazed into insert receiving cavities 68 within the forward working face 58 of the tooth 40 using conventional brazing techniques well known in the art to provide a conical cutting tip as shown in FIGS. 4 to 10. The depth of the insert receiving cavities 68 formed within the forward working face 58 and the projection of the inserts 60 from the insert receiving cavities 68 cooperatively provide a gage clearance "G" of approximately 0.34 inches between the conical tip 64 of the insert 60 and the forward working face 58 of the tooth body. This increased gage clearance "G" over prior art cutting teeth allows for improved cutting clearance for the tooth body to maximize cutting penetration of the insert 60 in the material to be cut and protect the tooth body from excessive wear.

It will be appreciated that the synergistic effect of the use of the conical tip inserts 60 and the angle of inclination of the cutting line 70 and cutting plane as described herein provides improved cutting clearance between both the conical tips of the inserts 60 and the body member 42 of the digging tooth 40 with respect to the work surface being cut thereby allowing for improved cutting performance.

The patents referred to herein are hereby incorporated by reference.

Having described presently preferred embodiments of the invention, it is to be understood that it may be otherwise embodied within the scope of the appended claims.

What is claimed is:

1. A replaceable digging tooth for an earth auger comprising:

a generally oblong body member including an elongated leading surface, an elongated trailing surface, and a first and second side surface, said leading and trailing surfaces and first and second side surfaces terminating in a forward working face having a plurality of inserts, each insert having a generally cylindrical portion integral a top portion which tapers to a point to form a conical tip; and a shank depending from said body member and receivable in a support block of the earth auger;

wherein said tips are aligned to define a linear cutting line which is inclined with respect to a reference plane perpendicular to the axis of said shank, and wherein the axes of said inserts are aligned parallel to form a cutting plane which is inclined with respect to said reference plane.

2. The digging tooth as set forth in claim 1 wherein the axis of said body member is nonlinear with the axis of said shank.

3. The digging tooth as set forth in claim 2 wherein the angle of inclination of said linear cutting line with respect to said reference plane is an acute angle of inclination.

4. The digging tooth as set forth in claim 3 wherein the angle of inclination of said linear cutting line with respect to said reference plane is approximately 10 degrees.

5. The digging tooth as set forth in claim 3 wherein the angle of inclination of said cutting plane with respect to said reference plane is an acute angle of inclination.

6. The digging tooth as set forth in claim 5 wherein the angle of inclination of said cutting plane with respect to said reference plane is approximately 50 degrees.

7. The digging tooth as set forth in claim 1 wherein the ratio of the diameter of said cylindrical portion of said insert to a spacing distance between said central insert axes of said inserts is between 0.45 and 0.80.

8. The digging tooth as set forth in claim 1 wherein the ratio of the diameter of said cylindrical portion of said insert to the spacing distance between said central insert axes of said inserts is between 0.50 and 0.80.

9. The digging tooth as set forth in claim 7 wherein the angle of taper formed by said top conical portion of said insert is between 60 degrees and 90 degrees.

10. The digging tooth as set forth in claim 9 wherein the angle of taper formed by said top conical portion of said insert is approximately 75 degrees.

11. The digging tooth as set forth in claim 10 wherein the ratio of the diameter of said cylindrical portion of said insert to the spacing distance between said central insert axes of said inserts is 0.72.

12. The digging tooth as set forth in claim 11 wherein said insert is made of cemented tungsten carbide

13. The digging tooth as set forth in claim 12 comprising four inserts secured to and spaced along said forward working face.

14. A tool for drilling holes in the earth comprising:

(a) an auger including:

(1) a central shaft terminating in a pilot bit at its lower end;

(2) a downwardly spiraling flight structure affixed to the shaft and extending generally radially therefrom, said flight structure terminating in a leading edge adjacent the pilot bit;

(3) a plurality of support blocks radially spaced along the leading edge of the flight structure which extend from an innermost position adjacent the central shaft to an outermost position adjacent to the outer rim of the flight structure, each support block having a tooth receiving pocket formed therein;

(b) a plurality of digging teeth mounted within respective support blocks, each of the digging teeth including:

(1) a generally oblong body member including an elongated leading surface, an elongated trailing surface, and a first and second side surface, said leading and trailing surfaces and first and second side surfaces terminating in a forward working face having a plurality of inserts, each insert having a generally cylindrical portion integral a top portion which tapers to a point to form a conical tip; and (2) a shank depending from said body member and receivable in a support block of the earth auger;

wherein said tips are aligned to define a linear cutting line which is inclined with respect to a reference plane perpendicular to the axis of said shank, and wherein the axes of said inserts are aligned parallel to form a cutting plane which is inclined with respect to said reference plane.

15. The tool for drilling holes in the earth as set forth in claim 14 wherein the axis of said body member is nonlinear with the axis of said shank.

16. The tool for drilling holes in the earth as set forth in claim 15 wherein the angle of inclination of said linear cutting line with respect to said reference plane is an acute angle of inclination.

17. The tool for drilling holes in the earth as set forth in claim 16 wherein the angle of inclination of said linear cutting line with respect to said reference plane is approximately 10 degrees.

18. The tool for drilling holes in the earth as set forth in claim 16 wherein the angle of inclination of said cutting plane with respect to said reference plane is an acute angle of inclination.

19. The tool for drilling holes in the earth as set forth in claim 18 wherein the angle of inclination of said cutting plane with respect to said reference plane is approximately 50 degrees.

20. The tool for drilling holes in the earth as set forth in claim 14 wherein the ratio of the diameter of said cylindrical portion of said insert to a spacing distance between said central insert axes of said inserts is between 0.45 and 0.80.

21. The tool for drilling holes in the earth as set forth in claim 14 wherein the ratio of the diameter of said cylindrical portion of said insert to the spacing distance between said central insert axes of said inserts is between 0.50 and 0.80.

22. The tool for drilling holes in the earth as set forth in claim 7 wherein the angle of taper formed by said top conical portion of said insert is between 60 degrees and 90 degrees.

23. The tool for drilling holes in the earth as set forth in claim 20 wherein the angle of taper formed by said top conical portion of said insert is approximately 75 degrees.

24. The tool for drilling holes in the earth as set forth in claim 23 wherein the ratio of the diameter of said cylindrical portion of said insert to the spacing distance between said central insert axes of said inserts is 0.72.

25. The tool for drilling holes in the earth as set forth in claim 24 wherein said insert is made of cemented tungsten carbide.

26. The tool for drilling holes in the earth as set forth in claim 25 comprising four inserts secured to and spaced along said forward working face.

* * * * *